US008359888B2

(12) United States Patent
Deppermann et al.

(10) Patent No.: US 8,359,888 B2
(45) Date of Patent: Jan. 29, 2013

(54) DISPENSING SYSTEM FOR POWDERED TREATING AGENT FOR USE IN A WASHING MACHINE, AND WASHING MACHINE

(75) Inventors: Thomas Deppermann, Guetersloh (DE); Michael Finke, Hoevelhof (DE); Olaf Witte, Detmold (DE)

(73) Assignee: Miele & Cie. KG, Guetersloh (DE)

( * ) Notice: Subject to any disclaimer, the term of this patent is extended or adjusted under 35 U.S.C. 154(b) by 1155 days.

(21) Appl. No.: 12/243,611

(22) Filed: Oct. 1, 2008

(65) Prior Publication Data

US 2009/0090139 A1 Apr. 9, 2009

(30) Foreign Application Priority Data

Oct. 8, 2007 (DE) ..... 10 2007 048 199

(51) Int. Cl.
*D06F 35/00* (2006.01)

(52) U.S. Cl. ..... 68/17 R; 222/144; 222/238; 222/348; 222/367; 222/368; 222/404

(58) Field of Classification Search ..... 68/17 R; 222/144, 325, 348, 367, 368, 238, 404
See application file for complete search history.

(56) References Cited

U.S. PATENT DOCUMENTS

| | | | | |
|---|---|---|---|---|
| 3,799,305 | A * | 3/1974 | Limberger | 192/33 R |
| 3,982,666 | A | 9/1976 | Kleimola et al. | |
| 4,144,093 | A | 3/1979 | Reinwald et al. | |
| 4,895,274 | A | 1/1990 | Morimoto et al. | |
| 5,142,887 | A | 9/1992 | Priem et al. | |
| 5,829,085 | A | 11/1998 | Jerg et al. | |
| 5,870,906 | A * | 2/1999 | Denisar | 68/17 R |
| 6,826,933 | B2 | 12/2004 | Merkle et al. | |
| 2005/0247742 | A1 * | 11/2005 | Livingston et al. | 222/444 |
| 2006/0107705 | A1 | 5/2006 | Hsu et al. | |

(Continued)

FOREIGN PATENT DOCUMENTS

| | | |
|---|---|---|
| CA | 2204784 | 5/1996 |
| DE | 3302893 | 8/1984 |

(Continued)

OTHER PUBLICATIONS

Machine translation of DE 19652787 to Boettger.*

(Continued)

*Primary Examiner* — Michael Kornakov
*Assistant Examiner* — Douglas Lee
(74) *Attorney, Agent, or Firm* — Leydig, Voit & Mayer, Ltd.

(57) ABSTRACT

A dispensing system for powdered treating agent for use in a washing machine includes a supply container for the treating agent, a delivery device configured to deliver the treating agent to the washing machine through a connecting hose, and a dosing device for dispensing the treating agent from the supply container to the delivery device. The supply container has an agitator with a first vertical rotatable shaft and rotatable blades. The dosing device includes a cylindrical chamber, with a compartmented wheel having spokes disposed therein. The compartmented wheel is disposed below a bottom of the supply container and is coupled to a second vertical rotatable shaft. The cylindrical chamber has an inlet opening disposed in the bottom of the supply container and an underside of the cylindrical chamber has an outlet opening to the delivery device. The compartmented wheel is also coupled to the vertical shaft of the agitator.

18 Claims, 5 Drawing Sheets

U.S. PATENT DOCUMENTS

| | | | | |
|---|---|---|---|---|
| 2006/0236468 | A1 * | 10/2006 | Choi et al. | 8/158 |
| 2007/0056330 | A1 | 3/2007 | Song | |
| 2007/0084253 | A1 | 4/2007 | Ehrlich et al. | |
| 2007/0144558 | A1 | 6/2007 | Classen et al. | |
| 2008/0107576 | A1 | 5/2008 | Zettlitzer et al. | |
| 2009/0090140 | A1 | 4/2009 | Deppermann et al. | |
| 2009/0090141 | A1 | 4/2009 | Deppermann et al. | |

FOREIGN PATENT DOCUMENTS

| | | | |
|---|---|---|---|
| DE | 3433429 | A1 | 3/1986 |
| DE | 3533754 | A1 | 4/1987 |
| DE | 9303690 | | 6/1993 |
| DE | 4439680 | | 6/1996 |
| DE | 19652787 | A1 | 7/1998 |
| DE | 19652787 | A1 * | 7/1998 |
| DE | 10234316 | | 2/2004 |
| DE | 10234316 | A1 * | 2/2004 |
| DE | 102005050083 | | 4/2007 |
| EP | 0297371 | | 1/1989 |
| EP | 0520956 | A1 | 12/1992 |
| FR | 1303147 | A | 9/1962 |
| JP | 2001314692 | A | 11/2001 |
| JP | 2008017943 | A | 1/2008 |
| WO | WO-0220893 | A1 | 3/2002 |
| WO | WO 03022121 | A1 * | 3/2003 |
| WO | WO-03022121 | A1 | 3/2003 |
| WO | WO-03023120 | | 3/2003 |
| WO | WO 2005058126 | A1 | 6/2005 |
| WO | WO-2005114115 | A1 | 12/2005 |
| WO | WO 2006061041 | A1 * | 6/2006 |
| WO | WO-2007027779 | | 3/2007 |
| WO | WO-2007146458 | A2 | 12/2007 |

OTHER PUBLICATIONS

Abstract of DE 10234316 to Koppenstein.*

* cited by examiner

DISPENSING SYSTEM FOR POWDERED TREATING AGENT FOR USE IN A WASHING MACHINE, AND WASHING MACHINE

CROSS REFERENCE TO RELATED APPLICATIONS

Priority is claimed to German patent application DE 10 2007 048 199.5, filed Oct. 8, 2007, which is hereby incorporated by reference.

FIELD

The present invention relates to a dispensing system for powdered treating agent for use in a washing machine, said dispensing system including at least one supply container for treating agents, such as detergent or washing or rinse additives.

In washing machines for domestic use, the detergent is usually manually introduced into a chamber and flushed with water into the suds container after the wash cycle has started. The user must observe the dosage instructions for the particular detergent used, and take care to fill the correct amount into the chamber. To facilitate charging with detergent or other additives, automatic dispensing systems are used in which a relatively large amount of detergent is stored in a supply container. Once a wash cycle is started, the preset amount of detergent will then be added to the wash liquid, which eliminates the need for the user to ensure that the proper amount of detergent is filled in each time a wash cycle is carried out. Such dispensing systems are frequently used especially in industrial washing machines.

A dispensing system for powdered detergent is described in EP 0 297 371 B1. The washing powder is released from a supply container into a mixing chamber, from where it is delivered to the washing machine. An agitator having at least one rotating blade agitates the powder within the container, causing it to flow through an opening onto a collecting plate. In the process, truncated-cone-shaped heaps are formed on the plates, rotating dispensing fingers removing said heaps from the plates into a mixing chamber located therebelow. Once the desired amount has been introduced into the mixing chamber, the mixing chamber is flushed with water, the outflowing detergent/water mixture being directed through a conduit to the washing machine. In this design, the amount that will actually be released onto the respective plate is uncertain. Depending on the properties of the powder, the truncated cones forming on the plate may differ in shape and have very different volumes.

Document WO 2007/027779 A1 describes a dispensing system for powdered treating agent, in which a perforated disk is disposed at the powder outlet to provide accurate volumetric metering. In that design, the amount to be metered is determined by the volume of the cylindrical hole. A rotating cover plate clears the hole to be filled and subsequently closes it, after which another rotating cover plate opens the hole at the lower end.

German document DE 93 03 690 U1 describes a dispensing system in which the predetermined amount of detergent is filled from a supply container into a drawer-like receptacle. The bottom of the container has an opening formed therein, downstream of which is located a compartmented wheel having a horizontal rotating shaft. When rotating the compartmented wheel, powder is released from the supply container through the opening thereof into one compartment at any one time, said one compartment moving downward as the compartment shaft rotates further, and subsequently releasing the powder into the receptacle through an opening located below the compartmented wheel. The compartments each receive a predetermined amount of powder, so that the metering is provided by the number of compartments that are emptied into the receptacle. In that design, however, inaccuracies may occur when the compartments are not completely filled due to the formation of lumps.

SUMMARY

In view of the above, an aspect of the present invention is to provide a dispensing system, or a washing machine, in such a way that precise dosing is achieved with simple means.

In an embodiment, the present invention provides a dispensing system for powdered treating agent for use in a washing machine. The dispensing system includes at least one supply container for the treating agent, a delivery device configured to deliver the treating agent to the washing machine through a connecting hose and a dosing device for dispensing the treating agent from the at least one supply container to the delivery device. The at least one supply container has an agitator with a first vertical rotatable shaft and blades configured to be rotated by the first vertical rotatable shaft. The agitator is drivable by an electric drive. The dosing device includes a cylindrical chamber and a compartmented wheel disposed therein. The compartmented wheel has a plurality of compartments separated by spokes. The compartmented wheel is disposed below a bottom of the at least one supply container and is coupled to a second vertical rotatable shaft. The cylindrical chamber has an inlet opening disposed in the bottom of the at least one supply container and is configured to fill the compartments therethrough. An underside of the cylindrical chamber has an outlet opening to the delivery device. The compartmented wheel is coupled to the first vertical rotatable shaft of the agitator.

BRIEF DESCRIPTION OF THE DRAWINGS

An exemplary embodiment of the present invention will be described in more detail below and is schematically shown in the drawings, in which.

DETAILED DESCRIPTION

Figure 1:
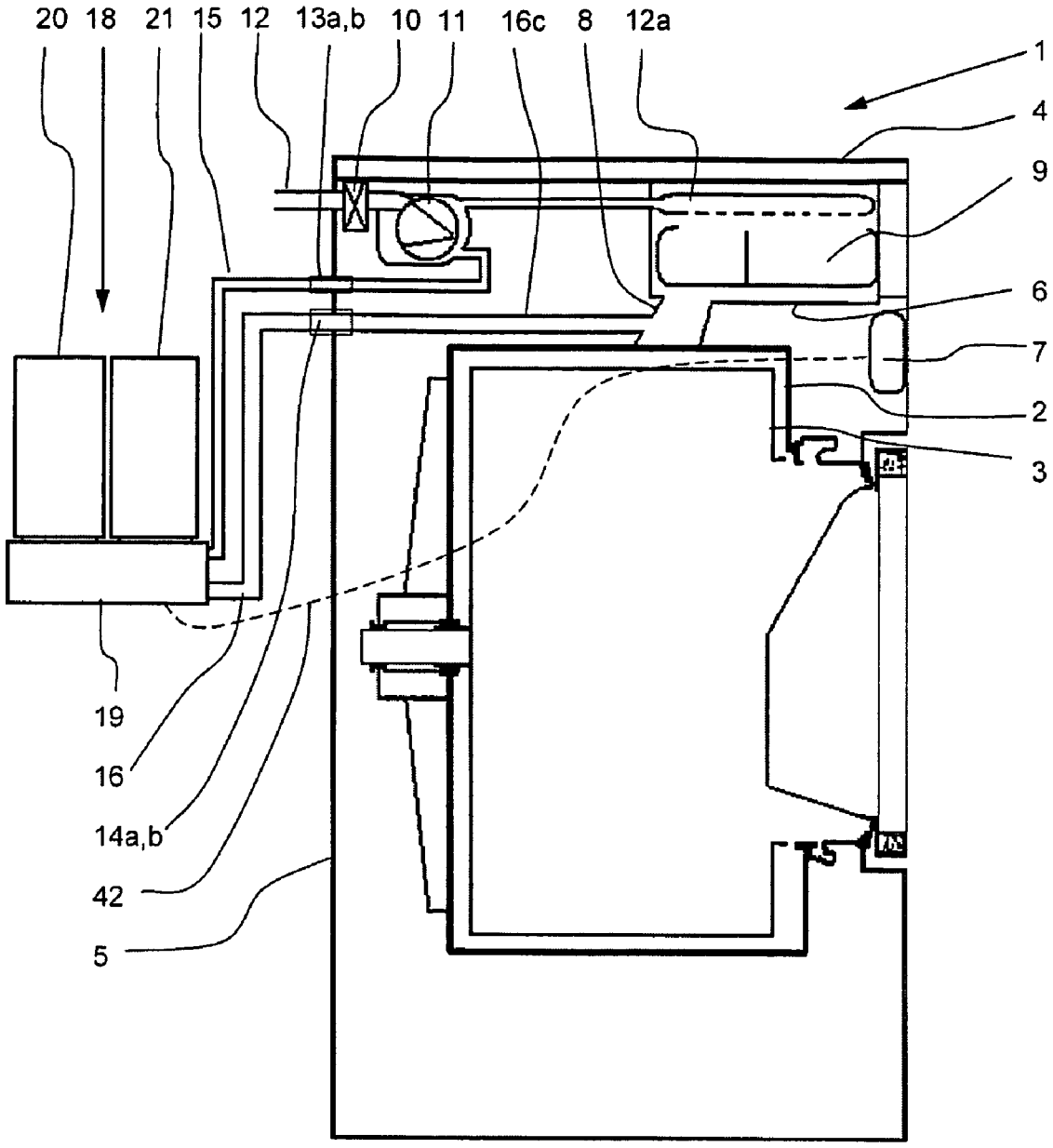
FIG. 1 is a schematic view showing the dispensing system connected to a washing machine.

The present invention relates to a dispensing system for powdered treating agent for use in a washing machine, said dispensing system including at least one supply container for treating agents, such as detergent or washing or rinse additives. The supply container has an agitator with rotating blades, the agitator being rotatable by means of a vertical rotating shaft and being coupled to and drivable by an electrical drive. The dispensing system also includes a delivery device adapted to deliver the treating agent through a connecting hose to the washing machine, and a dosing means for dispensing treating agent from the supply container into the delivery device.

The present invention also relates to a washing machine including a suds container for receiving wash liquid, a controller, and further including a dispensing system which may be located remotely from the washing machine and which is connected to the washing machine via two hose lines and is in operative connection with the controller of the washing machine.

The present invention allows automatic dispensing of precise amounts. To this end, the dosing means includes a cylindrical chamber containing a compartmented wheel which has a plurality of chamber segments or compartments separated by spokes and is disposed below the bottom of the supply container in such a manner that it is rotatable by means of a vertical rotating shaft The bottom of the supply container has formed therein an inlet opening for filling of the chamber segments therethrough, an outlet opening to the delivery device being provided at the underside. The compartmented wheel is coupled to the rotating shaft of the agitator. Therefore, an electrical drive is only needed for the agitator, whose rotating blades cause the powdered treating agent to flow into the chamber or into a chamber segment. At least one rotating blade is located near the bottom of the supply container, so that a compartment can be completely filled by scraping off the powder above the opening. Since the volume of one compartment is known, the amount to be dispensed is determined by the number of compartments to be emptied into the delivery device. The coupling is such that an agitator blade passes over the inlet opening at least once before the compartmented wheel rotates further. Directions and positions are given relative to the dispensing system and the washing machine in their normal position of use.

In an embodiment, the rotating shaft of the compartmented wheel is spaced from the rotating shaft of the agitator; the inlet opening and the outlet opening substantially corresponding in shape to the shape of a chamber segment; the inlet opening being located near the shaft of the agitator; and the outlet opening being located remote from the shaft of the agitator. This ensures that the treating agent is reliably and completely filled into a compartment at any one time, and that it is not released therefrom into the delivery device until the wheel has rotated further. This prevents treating agent from flowing through the chamber, as a result of which an increased amount would be added. Thus, precise dosing can be accomplished regardless of the flow or caking properties of the treating agent.

In an embodiment, the delivery device includes a detergent solution pump and a mixing chamber for receiving the treating agent to be dispensed, it being possible for the treating agent that is released into the mixing chamber to be flushed out by the inflowing water and be delivered to the washing machine by means of the detergent solution pump. This allows the dispensing system to be positioned as desired. It may even be positioned adjacent or below the washing machine because the detergent solution pump ensures that the treating agent/water mixture is introduced into the washing machine independently of gravity.

The coupling of the compartmented wheel may be accomplished by providing the shaft of the agitator with at least one dog which may extend into an opening into the chamber and thus cooperate with a spoke, allowing the compartmented wheel to be rotated through a partial revolution. To this end, the chamber is provided with an opening at the side where the compartments that do not contain detergent or treating agent are located. The sequence of movements performed by the compartmented wheel can be varied with respect to the sequence of movements performed by the agitator. The continuous rotation of the agitator may thereby be converted into a stepped rotation of the compartmented wheel.

In an embodiment, the dog is shaped such that a partial revolution of the rotating shaft of the agitator will advance the compartmented wheel by the position of at least nearly one compartment or segment. This ensures that the full inlet opening area is available for each compartment when it is filled, and that the full outlet opening area is available when the treating agent flows from the compartment into the delivery device.

In another embodiment, the shaft of the agitator is provided with at least two dogs which are offset by 180° from each other. Thus, when the agitator is rotated through a half revolution, the compartmented wheel is advanced by one compartment, so that the metering process can be carried out faster.

In a suitable embodiment, the opening is provided in the bottom of the container, i.e., at the top of the chamber, the dog being in the form of a claw or a downwardly angled pin and being attached to the shaft of the agitator. Cams may also be used as the dogs.

In order to prevent an excessive amount of detergent from flowing into this opening and affecting the movement of the dog, the dog or dogs is/are covered by a bell-shaped or conical cap in the central region of the container, said cap completely covering the opening through which the dogs extend into the chamber containing the compartmented wheel. The conical cap may also serve to hold the dogs, thus joining the dogs and the rotating shaft of the agitator in a simple and reliable manner.

In another embodiment, the dispensing system includes a base unit on which the supply container is removably placed and secured, along with the dosing means; the electrical drive and the delivery device, which includes a mixing chamber and a detergent solution pump, being disposed within the base unit. This allows the container to be easily removed for easy filling or cleaning, while allowing the base unit to remain in its installed position.

In one embodiment, the electrical drive includes an electric motor which is provided with a gear mechanism to form a gear motor, a coupling being attached to the gear output to provide for detachable connection to the agitator. The gear mechanism is coupled to the electric motor or formed as a unit therewith to provide a higher torque at the output of the gear mechanism. Thus, the motor can be of relatively low power and small size while still providing the torque required for breaking up and moving lumps of powder.

In an embodiment, the dispensing system includes two supply containers which are each provided with a dosing means, an agitator and an electrical drive for the agitator. The electrical drives for the agitators, and thus the dosing means, can be controlled individually, allowing the suitable treating agent to be selected automatically according to the wash cycle or the programmed sequence of washing steps.

In order to allow for filling of treating agent into the supply container, a filling opening is provided at the top of the supply container; i.e., the supply container is open at the top. To protect the user from contact with the agitator or any of the rotating blades and from any resulting injury during the filling operation, each supply container has a contact protection grille mounted in the filling opening thereof.

Furthermore, the supply containers can be inserted and secured in the base unit in the manner of a bayonet or a threaded connection. Thus, the supply containers are fixedly and non-rotatably mounted in the base unit, and thereby prevented from becoming detached as the agitator rotates. On the other hand, the user can easily detach and remove the containers from the base unit.

Overall, the washing machine may be adapted to the dispensing system in such a way that the controller of the washing machine is in communication with the dispensing system. Thus, depending on the wash cycle chosen, it is possible to select the container in the dispensing system that contains the right detergent, and to subsequently predetermine the amount to be dispensed.

The washing machine includes a connection which is controllable by an inlet valve and/or a water distributor and is connected to the dispensing system, and through which water can be delivered to the dispensing system, the washing machine further including an additional connection for the detergent solution that is deliverable from the dispensing system. The connection for the detergent solution is connected to the suds container via a flexible conduit, making it possible to compensate for the oscillatory movements of the suds container during operation.

In an embodiment, the washing machine has a detergent dispensing drawer disposed in the upper portion thereof, said detergent dispensing drawer being in communication via a water feed line for flushing detergents or additives out therefrom, the outlet of said detergent dispensing drawer being connected to the suds container via a flexible connecting tube, and the flexible conduit from the dispensing system opening into said connecting tube. This allows the user to continue to use detergents or treating agents in a conventional way. For example, in special treatments in which the stored agents cannot be used, such as when washing curtains or functional textiles, a special detergent is introduced via the detergent dispensing drawer into the suds container for one wash cycle at any one time.

Generally, the washing machine can have a housing including a rear wall which is provided with a connection for water supply to the solenoid valve and/or to the water distributor. In an embodiment, the rear wall is also provided with the connection for the water to the dispensing system and the connection for the detergent solution that is deliverable from the dispensing system.

Referring to FIG. 1, the illustrated washing machine 1 includes a suds container 2 in which is rotatably mounted a drum 3 which is driven by an electric motor. Dispensing system 18 is located outside washing machine 1 and connected thereto via connecting hoses 15, 16. The additives used may be, for example, detergents, washing additives or rinse additives. Dispensing system 18, which is separate from washing machine 1, may be placed and secured at different locations, as desired. Depending on the installation conditions of washing machine 1, the dispensing system may be placed or secured, for example, on housing 4 of washing machine 1, laterally adjacent thereto, or behind it. Washing machine 1 further includes a dispensing drawer 6 which may include a detergent compartment 9 for receiving the detergent for a wash cycle and which is connected to suds container 2 via a flexible tube 8. Dispensing drawer 6 is in communication with a water feed line 12, with a solenoid valve 10 and/or a water distributor 11 interposed therebetween, and allows detergent for a single wash cycle to be flushed into suds container 2 when dispensing system 18 is not used. Solenoid valve 10 and/or water distributor 11 are controlled by controller 7 of washing machine 1.

In order for detergent to be added from external dispensing system 18, water is supplied thereto via supply hose 15. The detergent/water mixture, i.e. the concentrated detergent solution, is delivered to washing machine 1 through detergent solution conduit 16; the rear wall 5 of washing machine 1 being provided with a connection 13*a* for coupling member 13*b* of water conduit 15 and with a connection 14*a* for coupling member 14*b* of detergent solution conduit 16. The detergent solution conduit 16*c* extending within the washing machine opens into flexible tube 8 on suds container 2. Solenoid valve 10, water distributor 11, and dispensing system 18 are controlled by controller 7 of washing machine 1, said controller also controlling the wash cycle sequence. Dispensing system 18 is operatively connected to controller 7 via signal connection 40. The dispensing system 18 of this embodiment includes a base unit 19 and two containers 20, 21 for powdered or granular detergent or treating agent.

Figure 2:
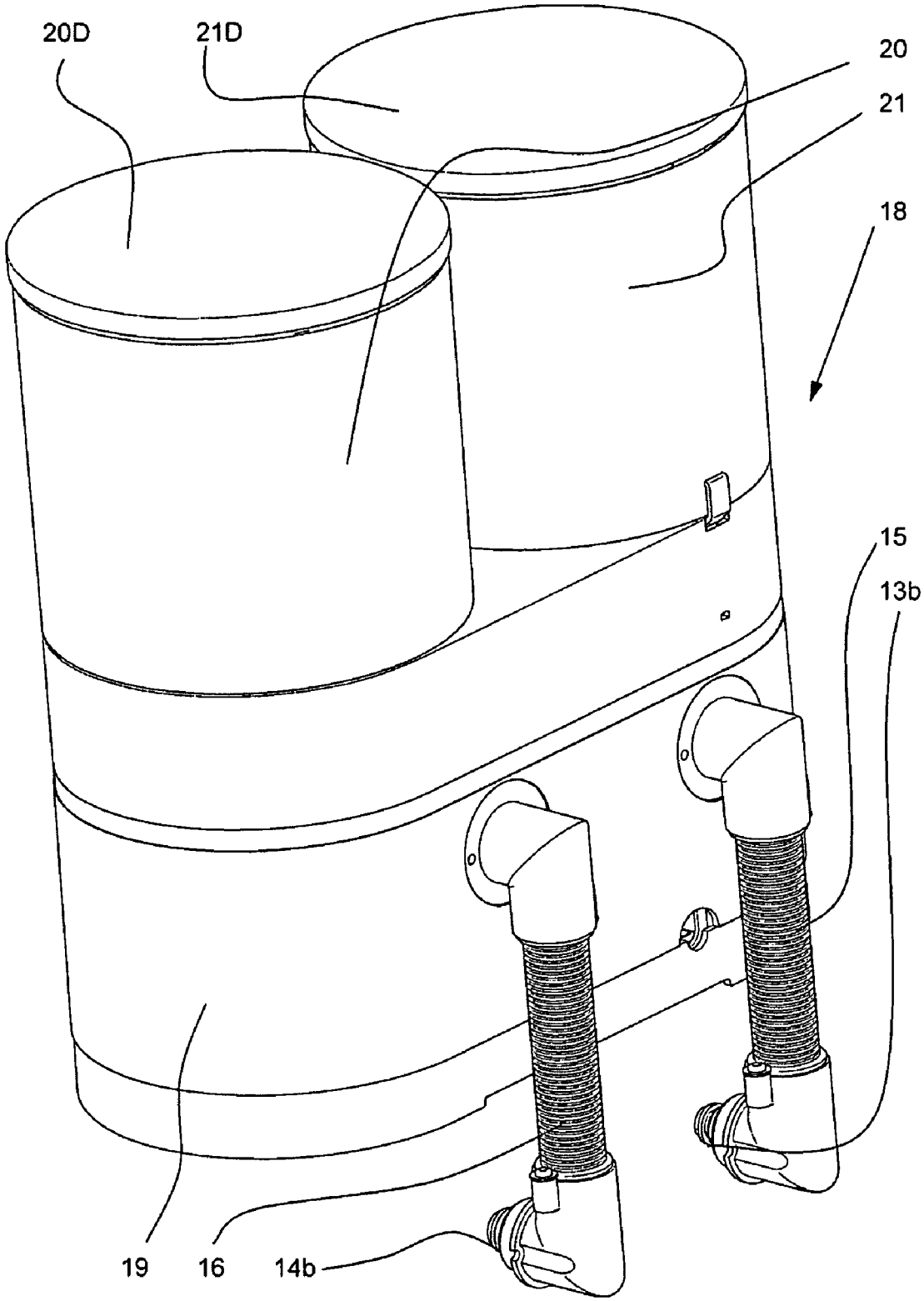
FIGS. 2 and 3 are detail views of the dispensing system.

FIG. 2 shows a detail view of an embodiment of dispensing system 18 which includes two supply containers. The containers 20, 21 for powdered treating agent are placed on base unit 19. Connecting hoses 15, 16 extend out of base unit 19 and are provided at their free ends with coupling members 13*b*, 14*b*, which are inserted and attached to their corresponding connections 13*a*, 13*b* (FIG. 1) provided on washing machine 1. Containers 20, 21 are each provided with a removable cover 20D, 21D to prevent the treating agents in containers 20, 21 from being contaminated and from absorbing moisture.

Figure 3:
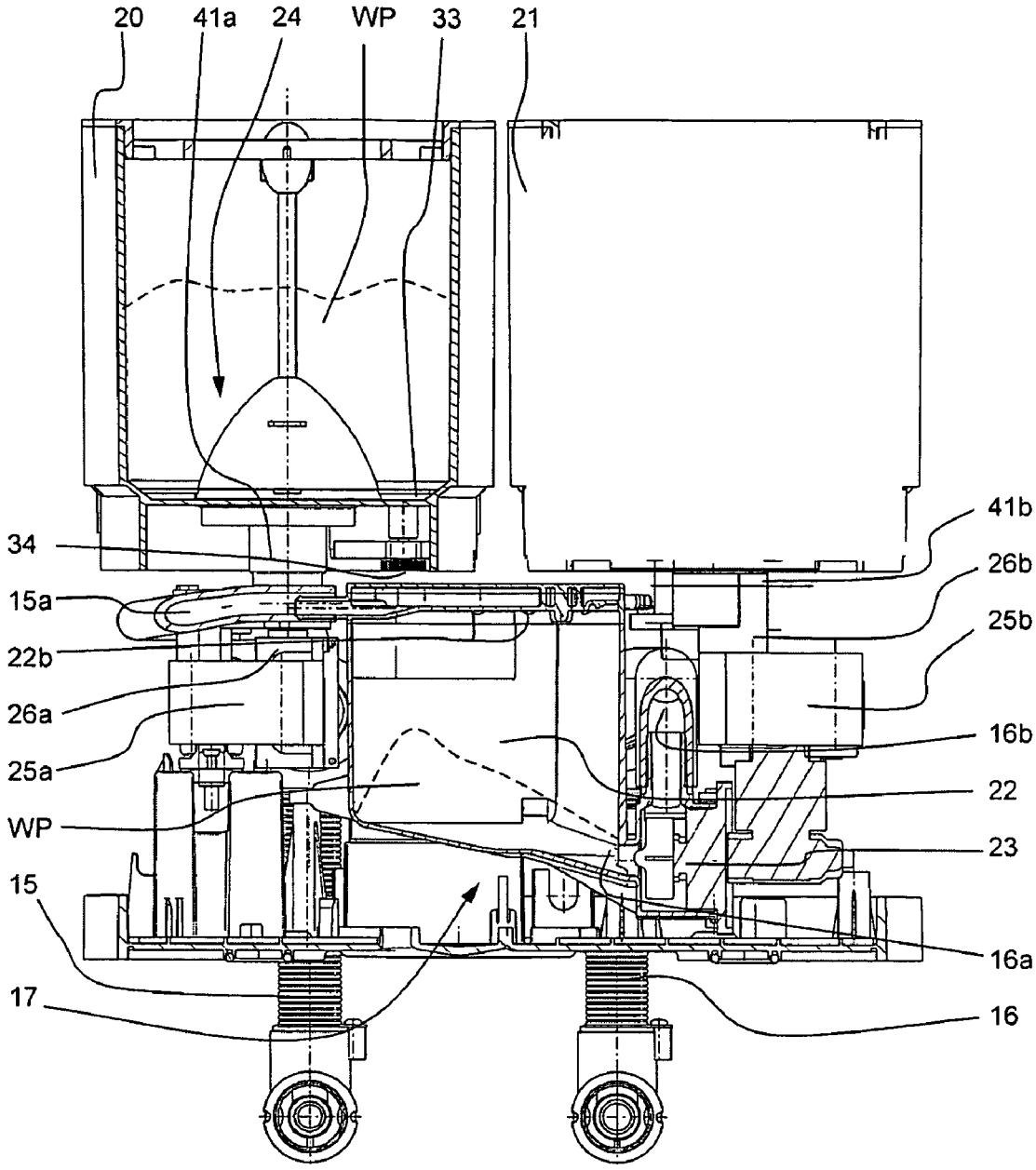

The cross-sectional view of FIG. 3 illustrates the interconnection of the component parts of dispensing system 18. Container 20 for powdered treating agent has disposed therein an agitator 24 having blades 37 (FIG. 4) or arms rotating about a vertical axis. Via an opening 33 in bottom 32 of container 20, treating agent WP is released into chamber 27 (FIG. 4); i.e., into one compartment 30 (FIG. 4) of chamber 27 at any one time. In the process, rotating blades 37 cause powdered treating agent WP to flow through opening 33 into compartment 30. Via outlet opening 34, the powdered treating agent is released from compartment 30 into mixing chamber 22. Agitator 24 is detachably connected to an electric motor 25*a*, i.e., to the output of gear mechanism 26*a*, via a coupling 41*a*. This allows container 20 to be removed from base unit 19 along with agitator 24, while electric motor 25*a* and gear mechanism 26*a* remain in base unit 19. A water inlet 15*a* connects to nozzles 22*b* directed into chamber 22 from above and is used to flush out the treating agent WP that was metered into mixing chamber 22. When water is, admitted to mixing chamber 22, the water mixed with the treating agent WP, i.e., the (usually concentrated) detergent solution, is directed through outflow portion 16*a* to the lower portion of chamber 22 and is pumped by detergent solution pump 23 through conduit 16*b* to detergent solution conduit 16. Thus, delivery device 17 is comprised of mixing chamber 22 and detergent solution pump 23.

The drive and the mounting arrangement for second container 21 are identical or at least similar in design. Container 21 is positioned such that the outlet opening is located above mixing chamber 22, so that the treating agent to be introduced can flow through the outlet opening into the mixing chamber when the second container has been selected. The agitator of second container 21 is also detachably connected to an electric motor 25*b*, i.e., to the output of gear mechanism 26*b*, via a coupling 41*b*. This allows container 21 to be removed from base unit 19 along with the agitator, while electric motor 25*b* and gear mechanism 26*b* remain in base unit 19.

Figure 4:
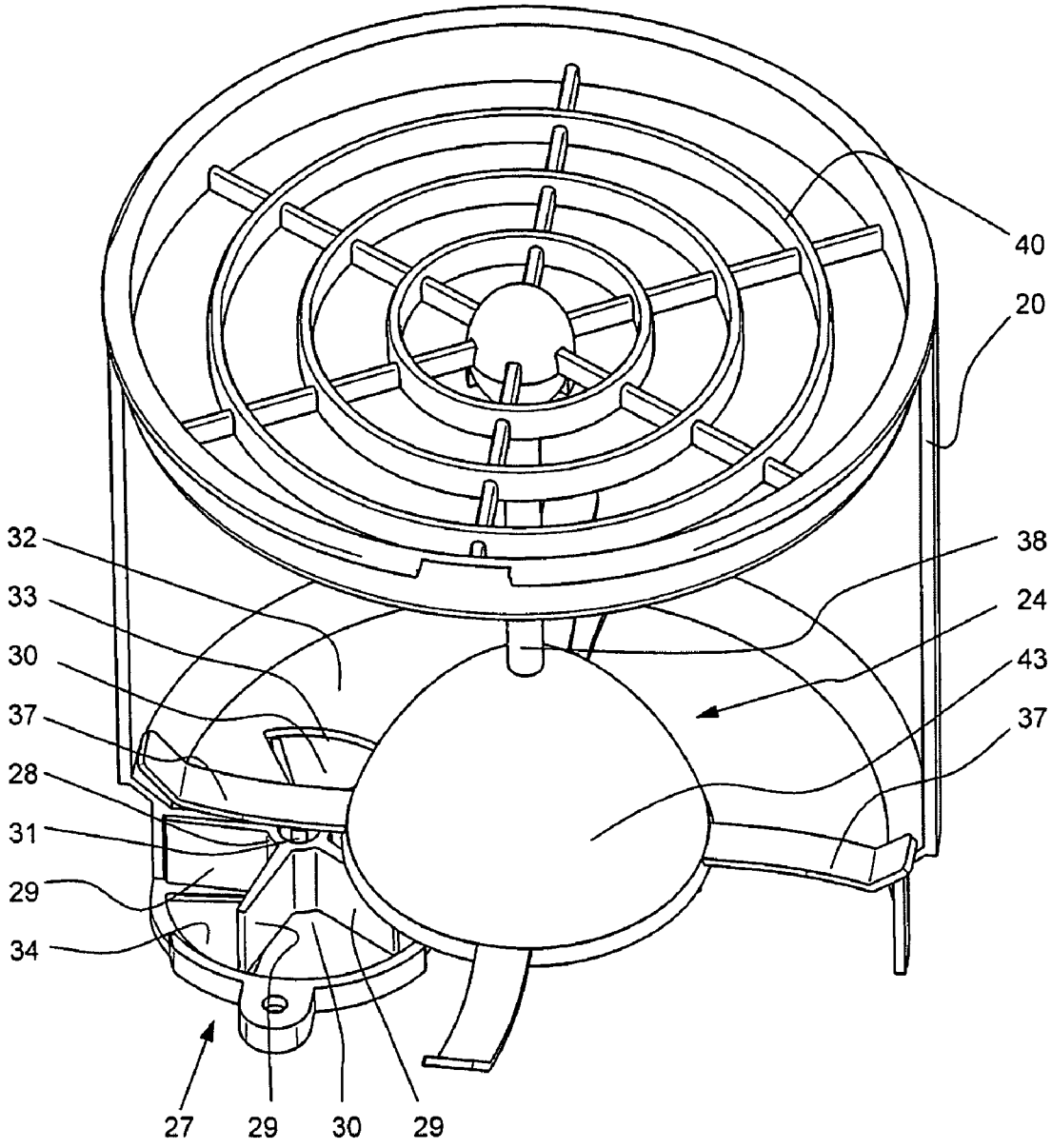
FIG. 4 is a perspective view of the interior of the dispensing system.

FIG. 4 is a detailed view of container 20, showing agitator 24 and cylindrical chamber 27 and the compartmented wheel 28 disposed therein. Agitator 24 is supported by a shaft 38 on container bottom 32 and by a contact protection grille 40 in the upper portion of container 20. Agitator 24 has a plurality of rotating blades 37, which sweep across the bottom 32 of container 20 in close proximity thereto as the agitator 24 rotates. Cylindrical chamber 27, which contains compartmented wheel 28, is disposed below container bottom 32. Compartmented wheel 28 is supported by a vertical rotating shaft 31, which is spaced from and parallel to rotating shaft 38 of agitator 24. Container bottom 32 has an inlet opening 33 formed therein, said inlet opening being located above chamber 27 and being substantially in the shape of a sector of a circle. Thus, this opening 33 is configured to match the shape of a compartment 30.

Figure 5:
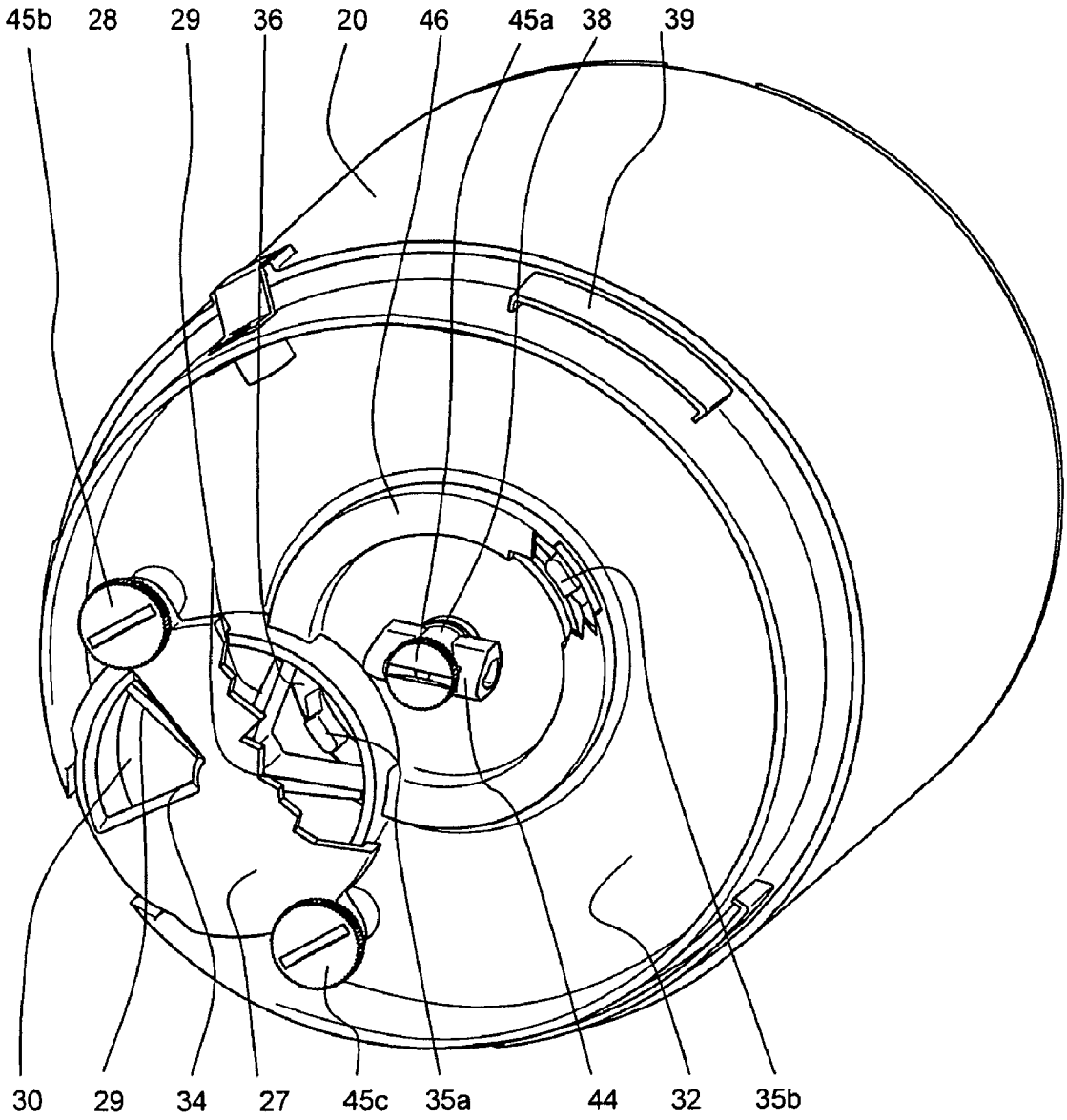
FIG. 5 is an isolated view of a container.

FIG. 5 is a view showing container 20 in a removed condition, looking at the underside thereof. Shaft 38 of agitator 24 is supported in the central region of bottom 32. Cylindrical chamber 17 is disposed between shaft 38 and the outer edge of bottom 32.

At least one pin 35*a* which acts as a dog is attached to rotating shaft 38 of agitator 24 such that it is spaced therefrom and parallel thereto. The aforesaid pin periodically extends into chamber opening 36 during its orbiting movement. An annular channel 46 is formed in bottom 32 of container 20. Dog 35*a* extends into the aforesaid annular channel and is able to move orbitally therein. This embodiment features two opposite pins 35*a*, 35*b*, so that each time the agitator is rotated through a half revolution, one of the pins 35*a*, 35*b* is moved through chamber 27 once. The chamber and annular channel 46 are shown with parts cut away to reveal pins 35*a*, 35*b*. In the process, one spoke 29 of compartmented wheel 28 is moved at any one time, said spoke 29 being advanced or rotated within chamber 27 by the position of one compartment 30, so that the entire compartmented wheel 28 is rotated through an angle corresponding to one compartment 30. During this partial revolution, all compartments 30 formed by spokes 29 of compartmented wheel 28 are advanced by said one position, so that a compartment 30 filled with treating agent WP reaches outlet opening 34 of chamber 27, allowing treating agent WP to flow through said opening 34 into mixing chamber 22 (FIG. 3). Second dog 35*b* also extends into annular channel 46. In the central region of the container, dogs 35*a*, 35*b* are covered by a cap 43 which, in this embodiment, is in the shape of a bell or cone.

Furthermore, a coupling element 44 is mounted on rotating shaft 38 of agitator 24 by a screw 45*a*, said coupling element engaging with a mating coupling element on the electrical drive as container 20 is inserted into base unit 19. Container 20 has formations 39 provided on its shell in the lower region thereof, said formations allowing attachment to mating means on base unit 19 in the manner of a bayonet (FIG. 2). After loosening coupling element 44, rotating shaft 38 can be withdrawn from the bearing in bottom 32 of container 20, allowing agitator 24 to be removed from container 20. Chamber 27 is screwed to the underside of container bottom 32 by screws 45*b*, 45*c*, so that it can be removed and cleaned after loosening said screws 45*b*, 45*c*. After removal of chamber 27, compartmented wheel 28 is also accessible, for example for cleaning purposes.

The present invention has been described herein based on one or more exemplary embodiments, but is not limited thereto. Reference should be had to the appended claims.

What is claimed is:

1. A dispensing system for powdered treating agent for use in a washing machine, the dispensing system comprising:

at least one supply container for the treating agent, the at least one supply container having an agitator with a first vertical rotatable shaft and blades configured to be rotated by the first vertical rotatable shaft, the agitator being drivable by an electric drive;

a delivery device configured to deliver the treating agent to the washing machine through a connecting hose; and a dosing device for dispensing the treating agent from the at least one supply container to the delivery device, the dosing device including a cylindrical chamber and a compartmented wheel disposed therein, the compartmented wheel having a plurality of compartments separated by spokes, the compartmented wheel being disposed below a bottom of the supply container and being coupled to a second vertical rotatable shaft that is spaced from the first vertical rotatable shaft, the cylindrical chamber having an inlet opening disposed in the bottom of the at least one supply container and configured to fill the compartments therethrough and an underside of the cylindrical chamber having an outlet opening to the delivery device, the inlet opening and outlet opening having a shape substantially corresponding to a shape of a compartment of the plurality of compartments, the inlet opening being disposed near the first vertical rotatable shaft and the outlet opening being disposed remote from the first vertical rotatable shaft, wherein the compartmented wheel is coupled to the first vertical rotatable shaft of the agitator, the first vertical rotatable shaft including at least one dog movable through the cylindrical chamber so as to contact the spokes of the compartmented wheel and rotate the compartmented wheel through a partial revolution.

2. The dispensing system as recited in claim 1 wherein the partial revolution is configured to advance the compartmented wheel by a position of at least one compartment.

3. The dispensing system as recited in claim 1 wherein the partial revolution is configured to advance the compartmented wheel by a position of nearly one compartment.

4. The dispensing system as recited in claim 1 wherein the at least one dog includes at least two dogs disposed opposite each other.

5. The dispensing system as recited in claim 4 further comprising a cap in a central region of the at least one supply container, the cap covering the opening and having a conical or bell shape.

6. The dispensing system as recited in claim 1 wherein the opening is disposed at a top of the chamber.

7. The dispensing device as recited in claim 1 wherein the at least one supply container includes a fill opening including a protection grill disposed therein.

8. The dispensing system as recited in claim 1 further comprising a base unit, the at least one supply container and dosing device being removably disposable and securable thereon, wherein the electrical drive and delivery device are disposed in the base unit, the delivery device including a mixing chamber and detergent solution pump.

9. The dispensing system as recited in claim 8 wherein the electrical drive includes an electric motor and a gear mechanism attached thereto so as to form a gear motor, wherein a gear output of the gear motor includes a coupling configured for detachable connection to the agitator.

10. The dispensing system as recited in claim 8 wherein the at least one supply container includes a first and a second supply container, wherein the agitator, dosing device and electrical drive are associated with the first supply container and further comprising a second agitator, second dosing device and second electrical drive associated with the second supply container, wherein the first and second agitators and dosing devices are individually controllable.

11. The dispensing device as recited in claim 10 wherein the first and second supply containers each include a fill opening with a protection grill disposed therein.

12. The dispensing system as recited in claim 8 wherein the base unit and the at least one supply container include respective portions of a bayonet connection configured to insert and secure the at least one supply container on the base unit.

13. The dispensing system as recited in claim 8 wherein the base unit and the at least one supply container include respective portions of a threaded connection configured to insert and secure the at least one supply container on the base unit.

14. A washing machine system comprising:

a washing machine including a suds container configured to receive wash liquid;

a dispensing system disposed remotely from the washing machine and connected to the washing machine by first and second hose lines, the dispensing system comprising:

at least one supply container for a treating agent, the supply container having an agitator with a first vertical rotatable shaft and blades configured to be rotated by the first vertical rotatable shaft, the agitator being drivable by an electric drive, a delivery device configured to deliver the treating agent to the washing machine through at least one of the first and second hose lines, and a dosing device for dispensing treating agent from the at least one supply container to the deliver device, the dosing device including a cylindrical chamber and a compartmented wheel disposed therein, the compartmented wheel having a plurality of compartments separated by spokes, the compartmented wheel being disposed below a bottom of the at least one supply container and being coupled to a second vertical rotatable shaft that is spaced from the first vertical rotatable shaft, the compartmented wheel being coupled to the first vertical rotatable shaft with the first vertical rotatable shaft including at least one dog movable through the cylindrical chamber so as to contact the spokes of the compartmented wheel and rotate the compartmented wheel through a partial revolution, the cylindrical chamber having an inlet opening disposed in the bottom of the supply container and configured to fill the compartments therethrough and an underside of the cylindrical chamber having an outlet opening to the delivery device, the inlet opening and outlet opening having a shape substantially corresponding to a shape of a compartment of the plurality of compartments, and the inlet opening being disposed near the first vertical rotatable shaft and the outlet opening being disposed remote from the first vertical rotatable shaft; and a controller, the dispensing system being in operative connection with the controller.

15. The washing machine system as recited in claim 14 further comprising:

a first connection controllable by at least one of an inlet valve and a water distributor and connected to the dispensing system, the connection being configured to deliver water to the dispensing system; and a second connection configured to deliver a solution of the treating agent from the dispensing system.

16. The washing machine system as recited in claim 15 wherein the second connection is connected to the suds container by a flexible conduit.

17. The washing machine system as recited in claim 16 further comprising a detergent dispensing drawer disposed in an upper portion of the washing machine, the detergent dispensing drawer being in communication with a water feed line operable to flush detergents or additives out of the detergent dispensing drawer, wherein an outlet of the detergent dispensing drawer is connected to the suds container with a flexible connecting tube, and wherein the flexible conduit opens into the flexible connecting tube.

18. The washing machine system as recited in claim 14 further comprising a housing with a rear wall, the rear wall including a first connection for a water supply to at least one of a solenoid valve and a water distributor, a second connection for water to the dispensing system and a third connection for a solution of the treating agent deliverable from the dispensing system.

* * * * *